US005400302A

United States Patent [19]

Yamamoto et al.

[11] Patent Number: 5,400,302

[45] Date of Patent: Mar. 21, 1995

[54] DIAL-TYPE TIMER DEVICE

[75] Inventors: Hiroyuki Yamamoto, Kyoto; Shintaro Ueno, Kyoto, both of Japan

[73] Assignee: Omron Corporation, Kyoto, Japan

[21] Appl. No.: 263,485

[22] Filed: Jun. 21, 1994

Related U.S. Application Data

[63] Continuation of Ser. No. 881,502, May 11, 1992, abandoned.

[30] Foreign Application Priority Data

May 10, 1991 [JP] Japan ..... 3-105725
Jul. 12, 1991 [JP] Japan ..... 3-062626 U
Jul. 19, 1991 [JP] Japan ..... 3-179573

[51] Int. Cl.[6] ..... G04F 8/00; H01H 7/08

[52] U.S. Cl. ..... 368/107; 200/38 R; 200/38 A

[58] Field of Search ..... 368/107, 113; 200/36, 200/38 R, 38 A, 38 P, 37 R, 37 A, 38 FA, 38 FB

[56] References Cited

U.S. PATENT DOCUMENTS 3,693,119 9/1972 Nakama et al. ..... 200/38 R
3,814,309 6/1974 Ramstetter ..... 200/38 R
3,823,547 7/1974 Hulterstrum et al. ..... 368/108

FOREIGN PATENT DOCUMENTS 0185291 6/1986 European Pat. Off. .
7432974 4/1976 Germany .
2234369 1/1991 United Kingdom .

OTHER PUBLICATIONS

Patent Abstracts of Japan vol. 10, No. 247 (p. 490), Aug. 1986.

*Primary Examiner*—Vit W. Miska
*Attorney, Agent, or Firm*—Dickstein, Shapiro & Morin

[57] ABSTRACT

A dial-type timer device having a timer body and a dial on a face of the timer body. A cover, including a locking pawl, is placed on the face of the timer body so that the dial protrudes through a hole therein. A setting ring is mounted on the dial and engages the locking pawl at a selected location to repeatedly set the time. Alternatively, two setting rings, each including a tooth on its outer periphery, are mounted on the dial to limit the range of rotation of the dial. Also, in a timing circuit of the timer, a dummy resistor of substantially the same impedance as an output relay, with its own switching element is connected in series with the output relay. By switching current alternatively through the output relay and the dummy resistor, fluctuation of current in the circuit is minimized and stable power is supplied to the time-limit circuit.

16 Claims, 16 Drawing Sheets

DIAL-TYPE TIMER DEVICE

This application is a continuation of U.S. patent application Ser. No. 07/881,502, filed May 11, 1992, now abandoned.

FIELD OF THE INVENTION

This invention relates to a dial-type timer. More specifically, it relates to a dial-type timer which employs one or more setting rings for repeatedly setting the same operating time or changing values within a limited range. It also relates to an improved switching circuit used in the timer.

BACKGROUND OF THE INVENTION

FIG. 1 shows an existing dial-type timer 20. Locking pawl 22 protrudes from an upper portion of the face 20*a* of the timer 20. Locking pawl 22 engages with a setting ring 23 (FIG. 2) mounted on dial 21 by engaging with a groove 23*a* on the outer periphery of the setting ring 23. In this way pawl 22 fixes the position of setting ring 23 and the dial 21. On the inner periphery of setting ring 23 are pawls 23*b*, which engage in slots 21*a* on the outer periphery of dial 21. Rotation of the setting ring 23 and the dial 21 sets the operating time.

Setting ring 23 is used to make it easier to set the timer dial 21 when the same operating time is set repeatedly. It also prevents accidental missettings resulting from different workers performing the same job. Dial 21 is set to the position which corresponds to the repeated operating time by the rotation of setting ring 23 to a position where the locking pawl 22 engages with groove 23*a* of the setting ring. The setting ring 23 engages with the sawteeth on the outer periphery of dial 21 in such a way that both the dial 21 and setting ring 23 rotate in unison. When the setting ring 23 and the dial are rotated so that slot 23*a* engages the pawl 22, the desired time is set.

With an existing dial-type timer of this type, locking pawl 22 on the upper portion of the face of the timer gets in the way when dial 21 is used without the setting ring 23, making the operation difficult.

Additionally, when dial-type timers are used in process control, they are not repeatedly set, but are set to values which should be changed only within a fixed range. However, existing dial-type timers are incapable of preventing values from being set beyond the upper and lower limits of the desired range. Thus, when such a dial-type timer is used for process control, the operator must pay careful attention whenever he changes a set value and note whether or not the new value falls within the fixed range of permitted values. He is, then, unable to relax. He may also mistakenly set values which exceed the fixed range.

The circuit design shown in FIG. 3 is well known as a timing mechanism of the type conventionally used. In FIG. 3, time-limit circuit 101, which comprises an integrated circuit (IC), and output relay 102 are connected in parallel to DC power supply 103 through switch 104. The base of an output switching element 105 is connected to the output terminal of the time-limit circuit 101. This element 105 is switched on and off by the output from time-limit circuit 101. The output relay 102 is connected in series with the collector-emitter pathway of output switching element 105. A diode 106 used to prevent reverse flow of current.

In an existing timing device constructed as described above, current I0 is supplied by DC power supply 103 when switch 104 is thrown. A part of this current, I1, is supplied to time-limit circuit 101, and circuit 101 operates and begins timing. After a specified time has elapsed, the aforesaid time-limit circuit 101 determines that the time is up. Its output causes switching element 105 to turn on, and output relay 102 is operated by current I2.

With the existing timing device described above, current I0, supplied by DC power supply 103, must be equal to I1+I2, that is, to the sum of the current supplied to the time-limit circuit 101 and that supplied to output relay 102. It is thus necessary to use a power supply with a current large enough to supply total current I0. Further, the current I0 supplied by DC power supply 103 is liable to fluctuate significantly when output relay 102 switches on or off. A power supply must be used which has sufficient capacity so that the power supply voltage V0 does not fluctuate when output relay 102 goes on or off. If the power supply does not have sufficient capacity, it will prove difficult to supply stable power to time-limit circuit 101. Without stable power, the circuit 101 will malfunction and the timing will be inaccurate.

SUMMARY OF THE INVENTION

In view of the foregoing, a need exists for a dial-type timer device which can be easily set to a specific time or to a time within a range. Also, a need exists for a power supply which can provide sufficient current and voltage for effective and accurate timing.

A primary object of the present invention is to improve the ease of operation of the dial when it was used with or without the setting ring. Another object of the invention is to make it possible to fix an upper and lower limit for values to be set, and to prevent values which exceed these limits from being set. Another objective is to provide a timing device which uses a small-capacity power supply and yet assures that the supply of power to the time-limit circuit is stable.

In order to achieve the objectives described above, one aspect of the invention includes a dial-type timer with a cover having an opening in it corresponding to the dial which can be mounted on the face of the timer. A locking pawl is located on the cover for engaging a slot on a setting ring mounted on the dial. The engagement of the pawl and the setting ring determines the position in which the setting ring and thus the dial is to be set. When the timer is used without the setting ring, the timer body can be used by itself without mounting the cover with the pawl. The locking pawl will not get in the way when the dial on the timer body is operated.

In addition, the cover encloses and protects the various setting switches and prevents them from being operated inadvertently. It also allows the color and appearance of the timer to be selected as desired, e.g., to match the design of the panel on which the timer is mounted. In other words, the addition of a cover allows the appearance of a dial-type timer to be changed.

In another aspect of the present invention, two setting rings are mounted on the perimeter of the dial in such a way that they rotate as a single piece with the dial. A molded tooth is formed on the perimeter of each of the setting rings. A stop on the body of the timer contacts with the teeth on the setting rings mounted on the dial so as to limit the range of rotation of that dial. The stop can be also included on a cover located on the front of the timer. The stop can be provided by the locking pawl described above.

In another aspect of the present invention the timing circuit of the dial-type timer includes a dummy resistor which has virtually the same impedance as the output relay. The output relay and the dummy resistor are each connected to their own switching elements, which go on and off in complementary fashion at the same time. These switching elements are operated by the on or off state of the output switching element. When timing is in progress, current flows along the route consisting of the switching element in parallel with the dummy resistor, and the time-limit circuit. When the time is up, current flows along the route consisting of the output relay, the switching element in parallel with the dummy resistor, and the time-limit circuit. The current, then, is not affected by the output relay being switched on or off. A steady current flows, and there is minimum fluctuation of current in the circuit as a whole. Thus stable power can be supplied to the time-limit circuit.

With these and other objects, advantages and features of the invention that may become hereinafter apparent, the nature of the invention may be more clearly understood by reference to the following detailed description of the invention, the appended claims and to the several drawings attached herein.

DETAILED DESCRIPTION OF THE PREFERRED EMBODIMENTS

Figure 4:
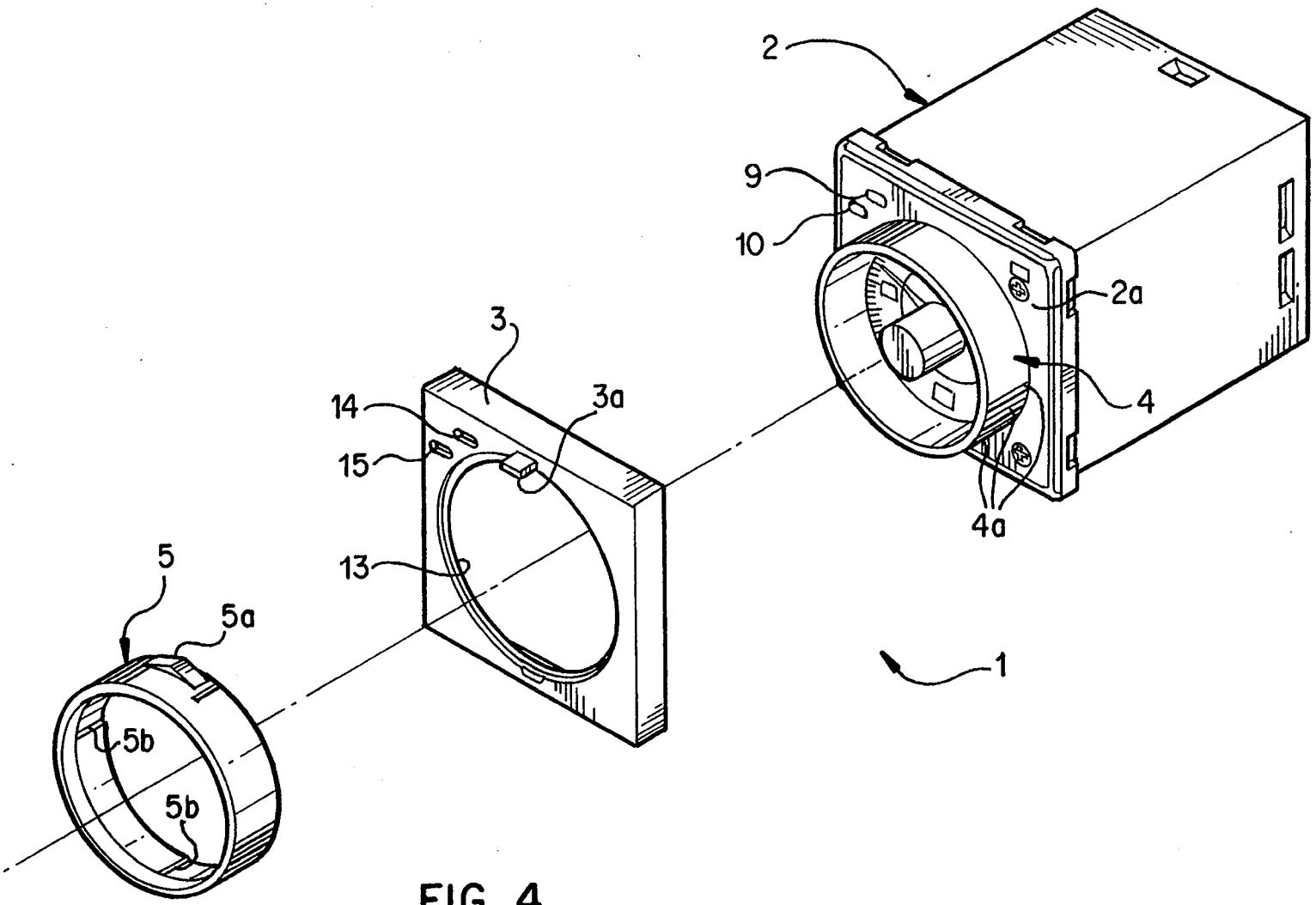
FIG. 4 is an exploded oblique view of a first embodiment of the present invention.

Referring now in detail to the drawings wherein like parts are designated by like reference numerals throughout, there is illustrated in FIG. 4 an exploded oblique view of a dial-type timer in which a first embodiment of the present invention has been implemented. The timer 1 consists of timer body 2 housing a timing mechanism; cover 3, which can be mounted on the face 2*a* of the said timer body 2; and setting ring 5, which is mounted on dial 4 on timer body 2 when the cover 3 is in place. The timer body 2 refers to both the timer housing and the timing mechanism contained therein.

Figure 5A:
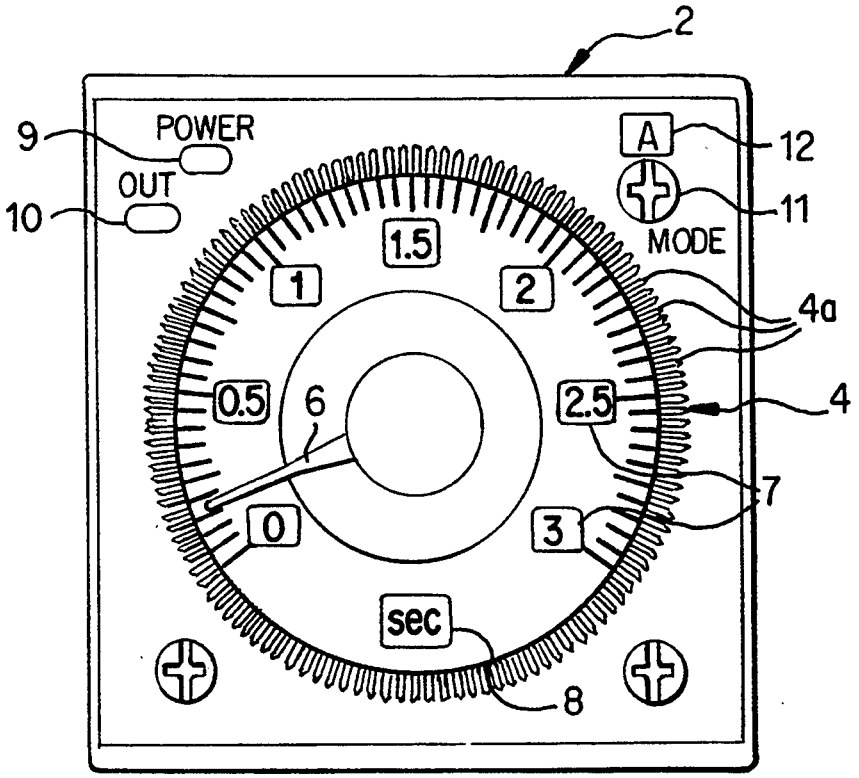
FIGS. 5A and 5B show a frontal view and a partial side view of the timer body.
Figure 5B:
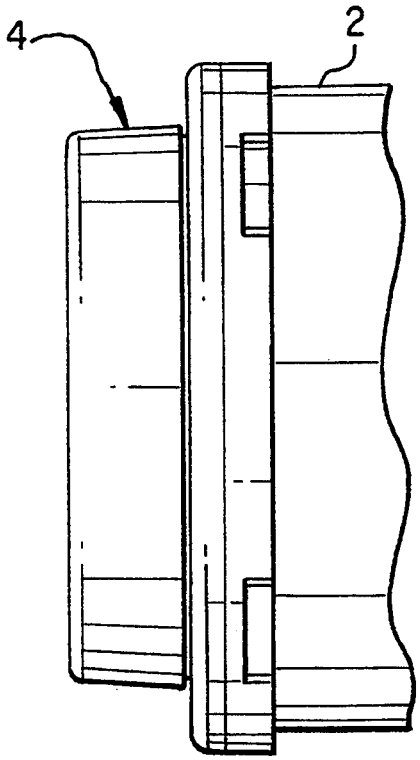

Timer body 2 has a dial 4 on its face 2*a* which is used to set the time. The outer periphery of this dial 4 is formed into grooves 4*a*, as can be seen in the frontal view in FIG. 5A. Dial 4 has an indicator 6 and a scale along its circumference for setting the time. It also has a number of windows 7 to display the numerals for the scale, and a window 8 to display the time units. Along the circumference of dial 4 are POWER and OUT displays 9 and 10, operating function switch 11 and operating function display window 12. FIG. 5B is a partial side view of the face of timer body 2.

Figure 1:
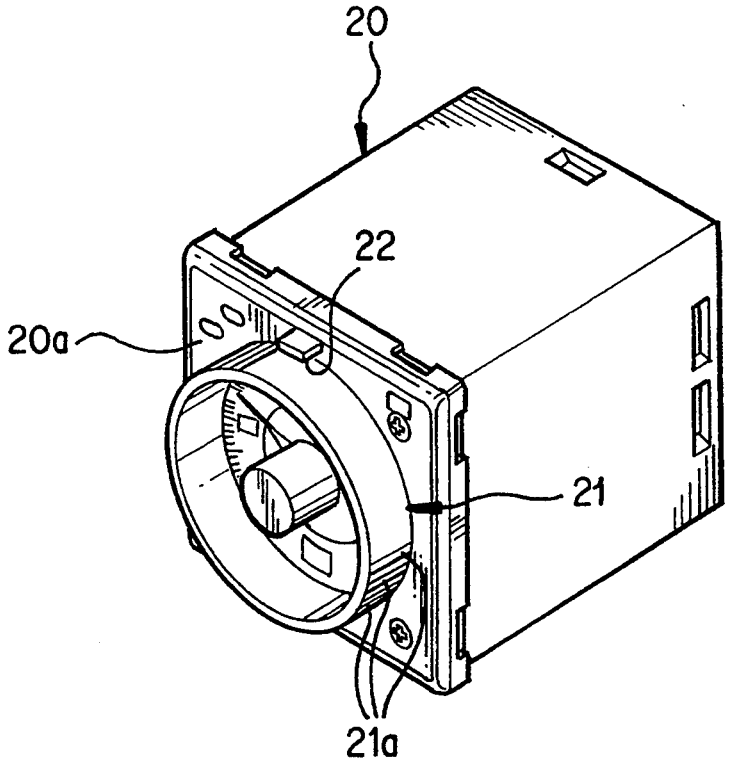
FIG. 1 PRIOR ART
FIG. 1 is an oblique view of an existing timer.
Figure 2:
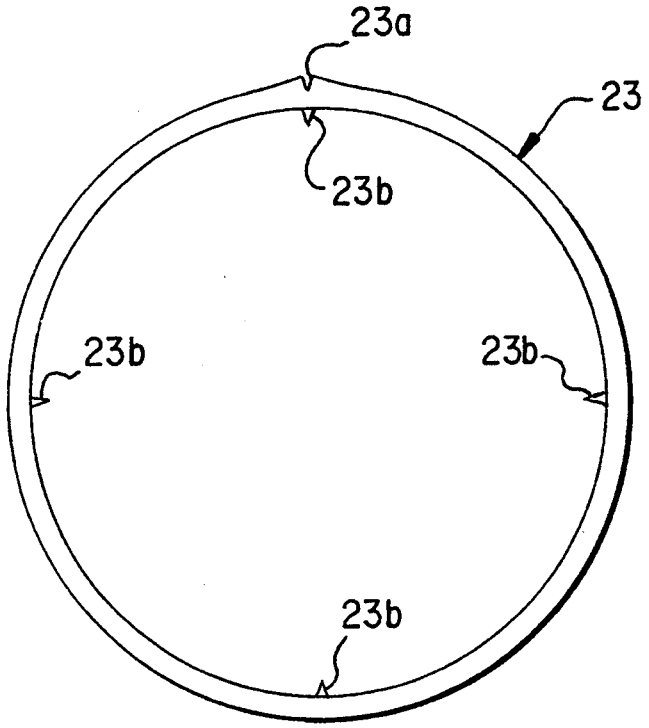
FIG. 2 PRIOR ART
FIG. 2 shows the setting ring of an existing timer.
Figure 3:
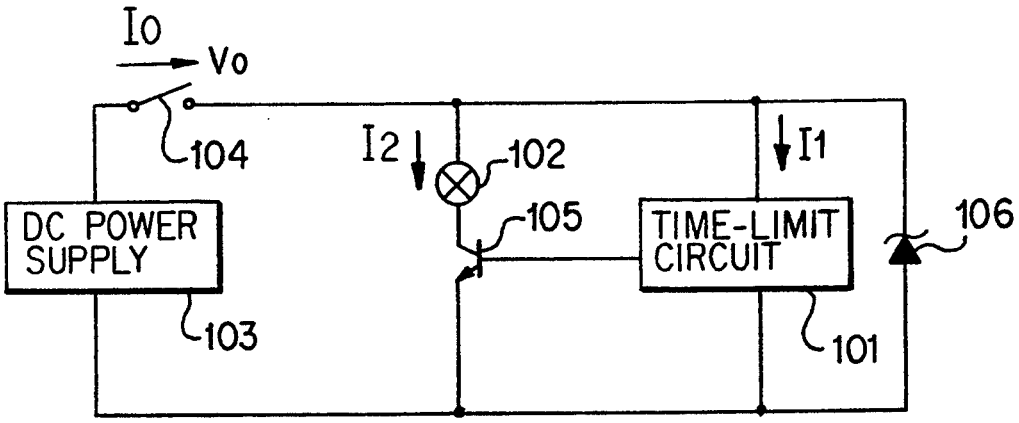
FIG. 3 PRIOR ART
FIG. 3 shows the configuration of the circuit in an existing timing device.

The structure described above is basically the same as that of the existing timer shown in FIG. 1. However, the timer of this invention does not have a locking pawl on the upper portion of the face 2*a* of the timer body 2 to engage in the groove on a setting ring 5. The locking pawl, then, does not get in the way when dial 4 is operated, so the timer is easier to operate than the FIG. 1 timer described above.

Cover 3 is mounted on the face of timer body 2 when a setting ring 5 is to be used. It has a round opening 13 for dial 4, and openings 14 and 15 for displays 9 and 10 on timer body 2. Openings 13 through 15 are the only windows in cover 3. When this cover is mounted on the face of timer body 2, operating function switch 11 and the other setting switches are completely enclosed. With the cover in place, there is no possibility that anyone will operate these switches mistakenly.

Figure 6A:
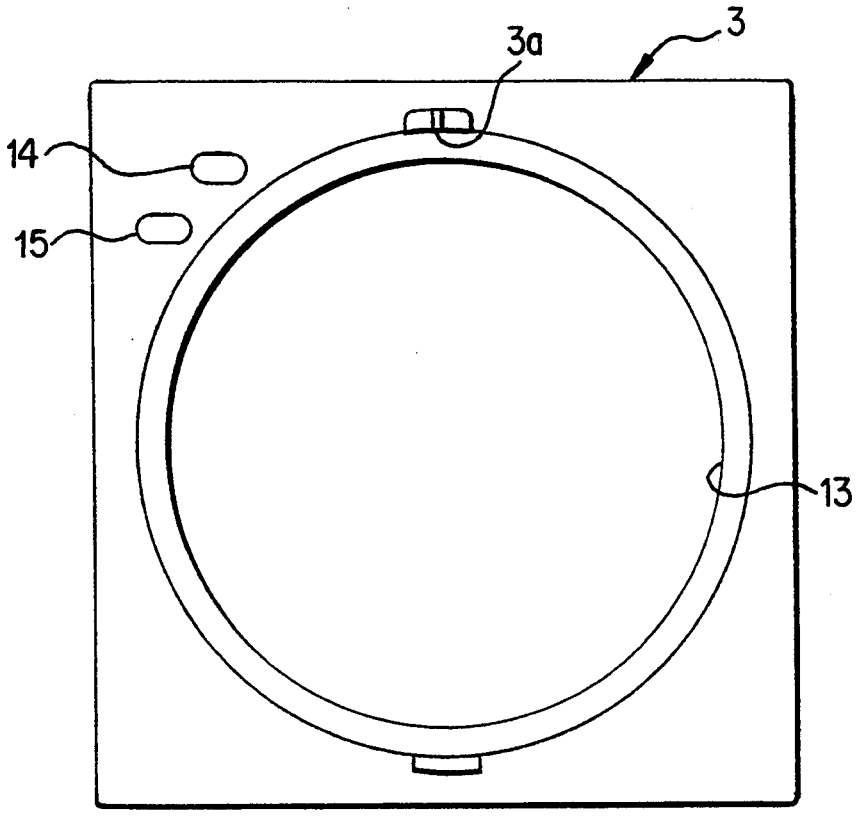
FIGS. 6A and 6B show a frontal view and a cross section of a side view of the cover.
Figure 6B:
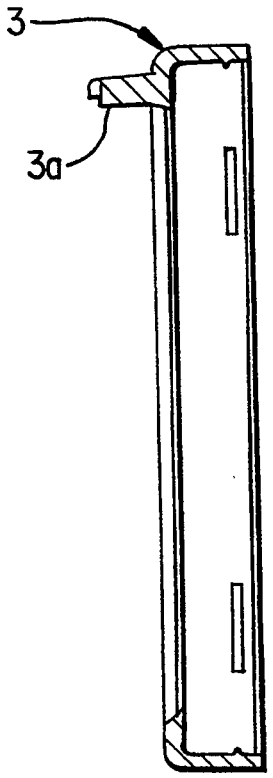

Cover 3 has a single locking pawl 3*a* molded on its face in a location corresponding to the upper portion of the face of timer body 2 when the cover is mounted on the timer body, as shown in the front view in FIG. 6A and the cross section of a side view in FIG. 6B. This locking pawl engages in the slot on the outer periphery of setting ring 5.

Figure 7A:
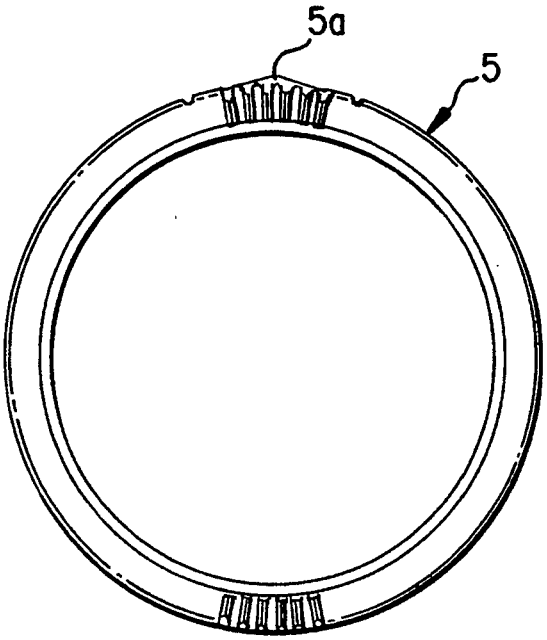
FIGS. 7A, 7B and 7C show a frontal view, a cross sectional side view and a rear view of the setting ring.
Figure 7B:
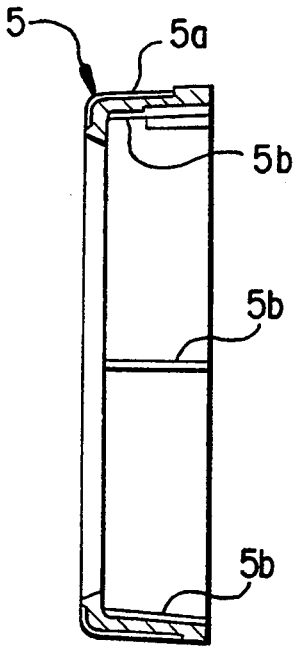
Figure 7C:
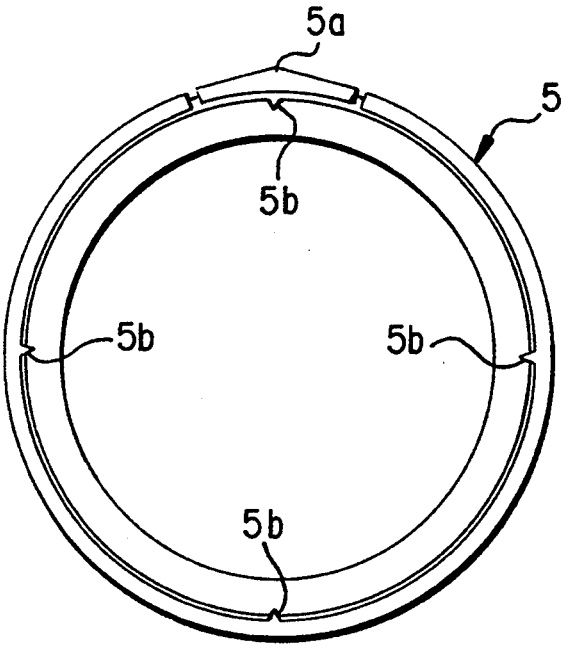

Setting ring 5 engages in grooves 4*a* on the outer periphery of dial 4. Dial 4 projects forward through opening 13 of cover 3 when the cover is mounted on the face of timer body 2. On the outer periphery of setting ring 5 is slot 5*a*, into which locking pawl 3*a* on cover 3 engages, as shown in the front view, cross sectional side view and rear view pictured in FIGS. 7A, 7B, and 7C. In four locations on the inner periphery of setting ring 5, pawls 5*b* are provided, which engage in grooves 4*a* on the outer periphery of dial 4. In this way dial 4 and setting ring 5 are made to rotate as a single entity.

Figure 8A:
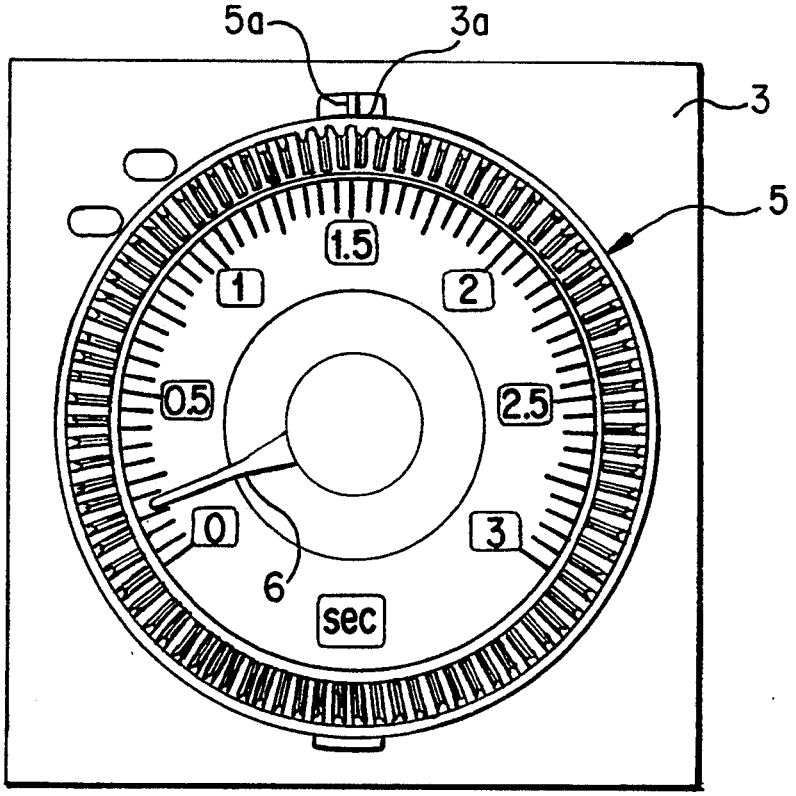
FIGS. 8A and 8B show a front view and a partial side view of the timer with cover and setting ring mounted on it.
Figure 8B:
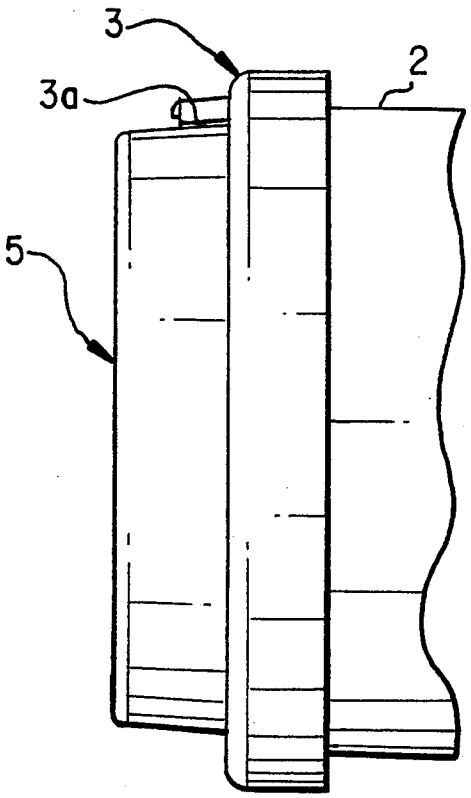

When setting ring 5 is to be used with dial-type timer 1, which has the configuration described above, cover 3 with its locking pawl 3*a* is mounted on the face of timer body 2. Dial 4 is then set in the position corresponding to the regular operating time. The aforesaid setting ring 5 is locked onto the outer periphery of dial 4 in such a way that locking pawl 3*a* on cover 3 engages in slot 5*a* on the outer periphery of the setting ring. The frontal view and partial side view pictured in FIGS. 8A and 8B show the setting ring locked onto the dial.

When dial 4 is to be set to a repeated operating time, as discussed earlier, it is returned to the position in which locking pawl 3*a* on cover 3 engages in slot 5*a* on setting ring 5. This enables the timer to be set to the designated position.

The materials used for cover 3 and setting ring 5 of this invention are available in a variety of colors, so they can be chosen to match the color of the panel on which timer body 2 is mounted. This ensures an esthetically pleasing result.

With the first embodiment of the present invention described above, a cover with a locking pawl on it is mounted on the timer when the setting ring is to be used. This allows the timer to function in the same way as previous timers of this type. When the setting ring is not going to be used, the cover is removed from the timer so that the locking pawl does not interfere with the operation of the dial. The result is a timer with improved ease of operation.

Figure 9:
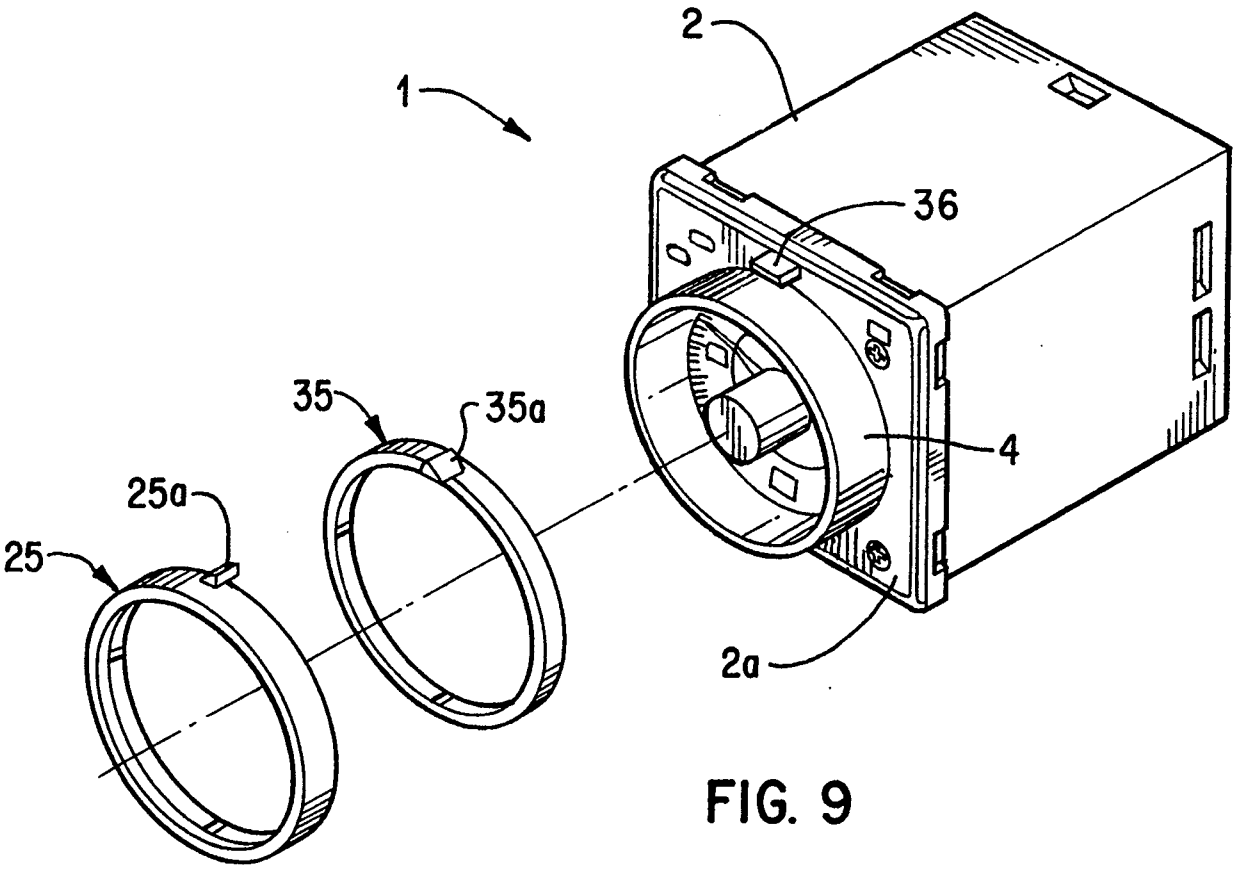
FIG. 9 is an exploded oblique view of a second embodiment of the present invention.

FIG. 9 is an oblique exploded view of a dial-type timer in a second embodiment of the present invention. The dial-type timer 1 of this embodiment consists of timer body 2; dial 4, which is used to set the operating time for timer body 2; and setting rings 25 and 35, which are mounted on the perimeter of dial 4. These setting rings limit the range in which dial 4 can be set.

Figure 10A:
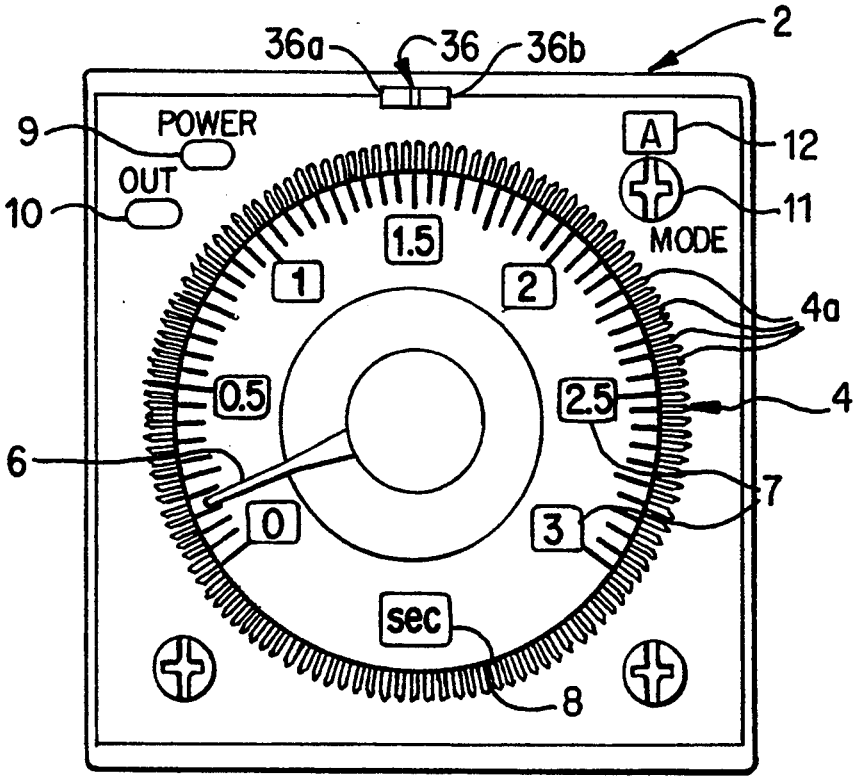
FIGS. 10A and 10B show a frontal view and a partial side view of the body of the timer.
Figure 10B:
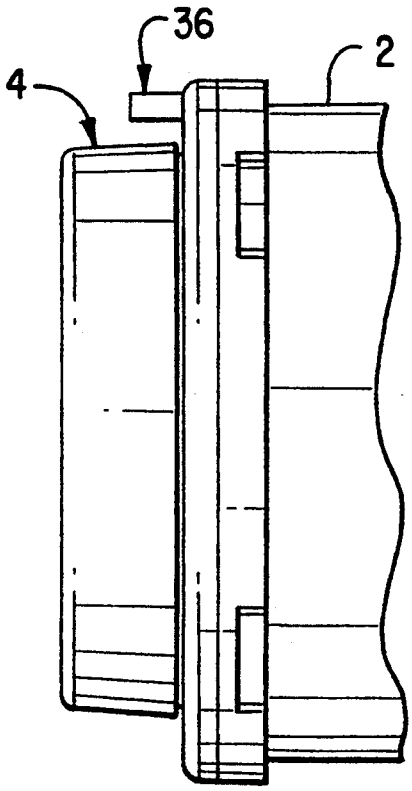

Stop 36 protrudes from the upper portion of the face of on timer body 2. This stop limits the range of rotation of dial 4 when it comes in contact with teeth 25*a* and 35*a* on setting rings 25 and 35. As can be seen in the frontal view pictured in FIG. 10A, the perimeter of dial 4 on timer body 2 is formed into grooves 4*a*. Dial 4 has an indicator 6 and a scale along its circumference for setting the time. It also has a number of windows 7 to display the numerals for the scale, and a window 8 to display the time unit. Grooves 4*a* on the perimeter of dial 4 are used to determine the position in which setting rings 25 and 35 are to be mounted. For that reason they are cut at a pitch of ½ the scale units for setting the time. Along the circumference of dial 4 are POWER and OUT displays 9 and 10, operating function switch 11 and operating function display window 12. FIG. 10B is a partial side view of the face of timer body 2.

Figure 11A:
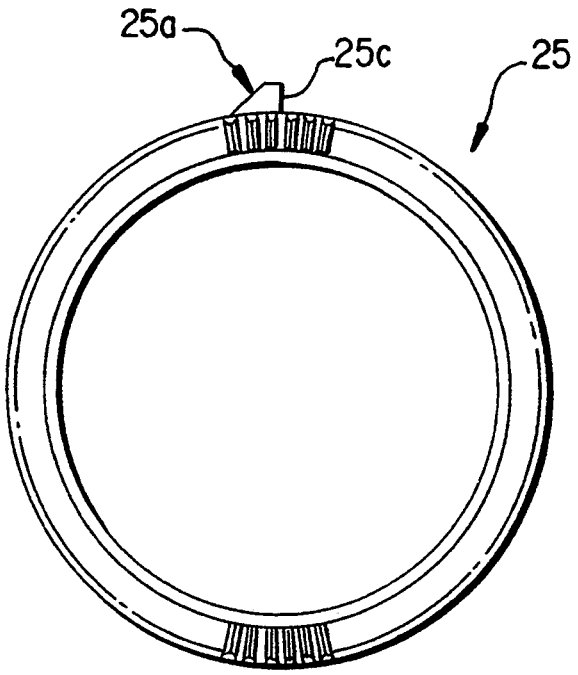
FIGS. 11A and 11B show front and rear views of one of the setting rings.
Figure 11B:
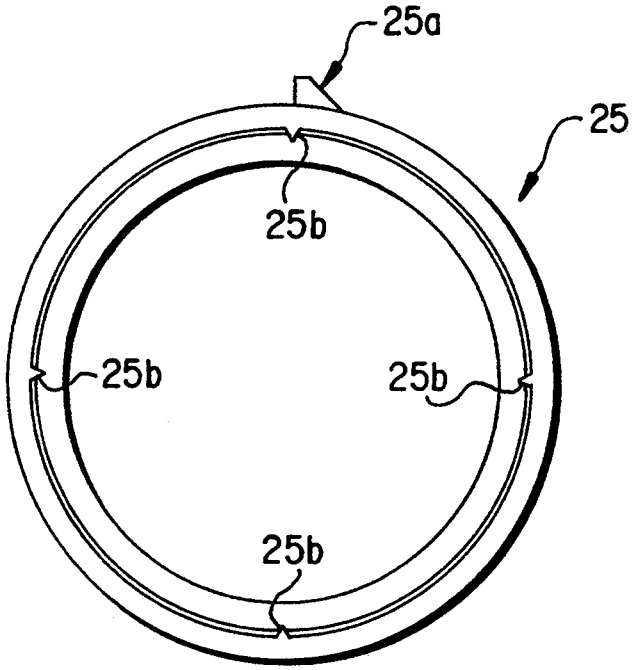

Front and rear views of setting ring 25 are shown in FIGS. 11A and 11B. This setting ring is mounted in such a way that pawls 25*b*, located at four locations on the inner periphery of setting ring 25, engage in grooves 4*a* on the perimeter of dial 4 on timer body 2. Tooth 25*a*, which protrudes from the perimeter of the setting ring, comes in contact with stop 36 on timer body 2. Its surface 25*c* makes contact with surface 36*a* of stop 36 on the timer body, which is shown in FIG. 10A.

Figure 12:
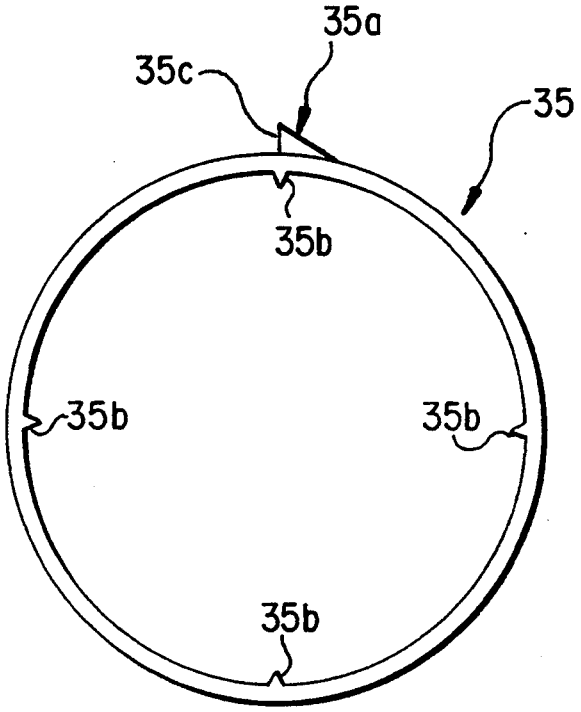
FIG. 12 shows a front view of the other setting ring.

A front view of the second setting ring, setting ring 35, is shown in FIG. 12. This setting ring is also mounted so pawls 35*b*, located on the inner periphery of the setting ring 35, engage in grooves 4*a* on the perimeter of dial 4 on timer body 2. Tooth 35*a*, which protrudes from the perimeter of the setting ring, comes in contact with stop 36 on timer body 2. Its surface 35*c* makes contact with surface 36*b* of stop 36 on the timer body, which is shown in FIG. 10A.

Figure 13A:
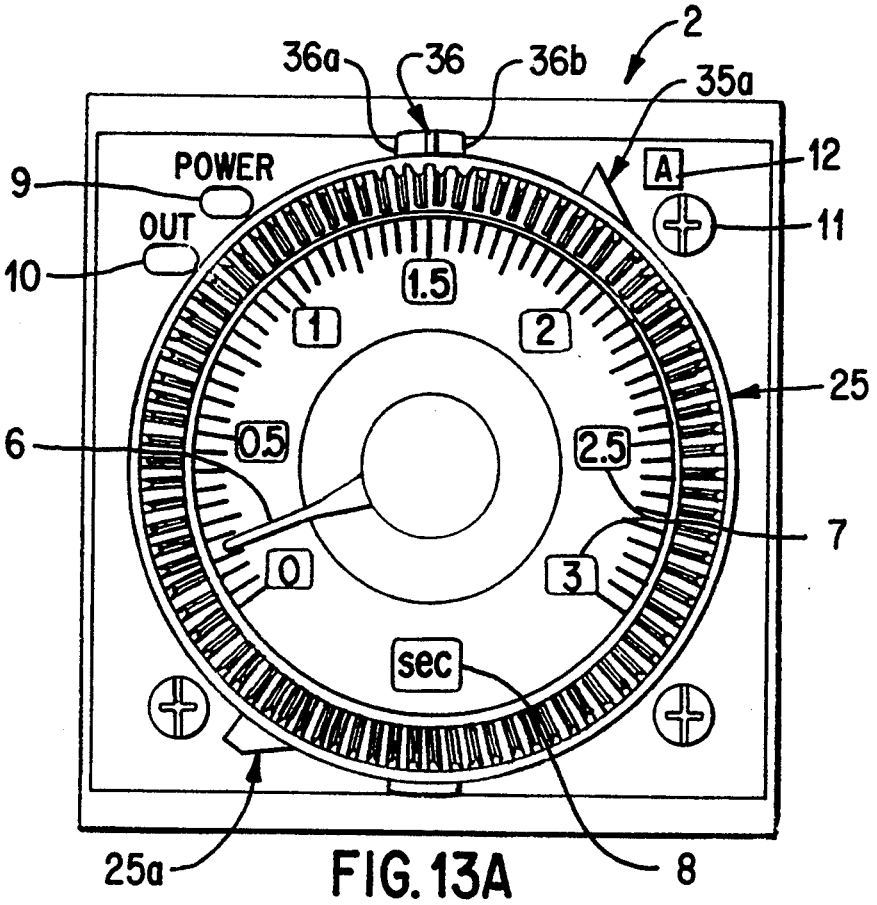
FIGS. 13A and 13B show a frontal view and a partial side view of the timer body with the two setting rings mounted on it.
Figure 13B:
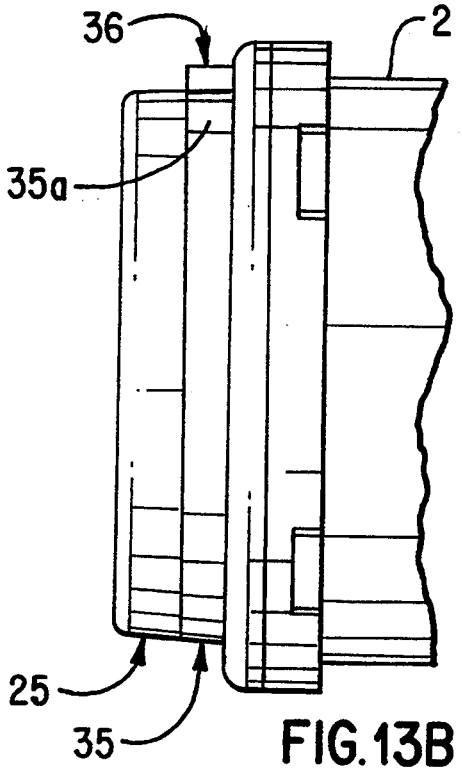

In a dial-type timer constructed as described above, the range of settings is controlled by the dial through the use of setting rings 25 and 35. When dial 4 is set in the position corresponding to the lower limit of the allowable values, surface 35*c* of tooth 35*a* on setting ring 35 comes in contact with surface 36*b* of stop 36 on timer body 2. When dial 4 is set in the position corresponding to the upper limit of the allowable values, surface 25*c* of tooth 25*a* on setting ring 25 comes in contact with surface 36*a* of stop 36 on timer body 2. The configuration of the timer body 2, the dial 4 and the setting rings 25, 35 is in the frontal view shown in FIG. 13A and the partial side view in FIG. 13B.

Thus, dial 4 and setting rings 25 and 35 rotate as a single entity, and the setting on dial 4 can be changed only within the range between tooth 25*a* on setting ring 25 and tooth 35*a* on setting ring 35. The operator is prevented from setting any value outside of that range.

For stop 36, which protrudes from the surface of the face of timer body 2, a lock generally found in existing timers can be used. This lock protrudes from the upper portion of the face of the timer. It is used to determine the reset position of the setting ring so that it can be reset easily when a standard operating time is being set repeatedly. This lock can be used for both purposes in the new timer.

Figure 14:
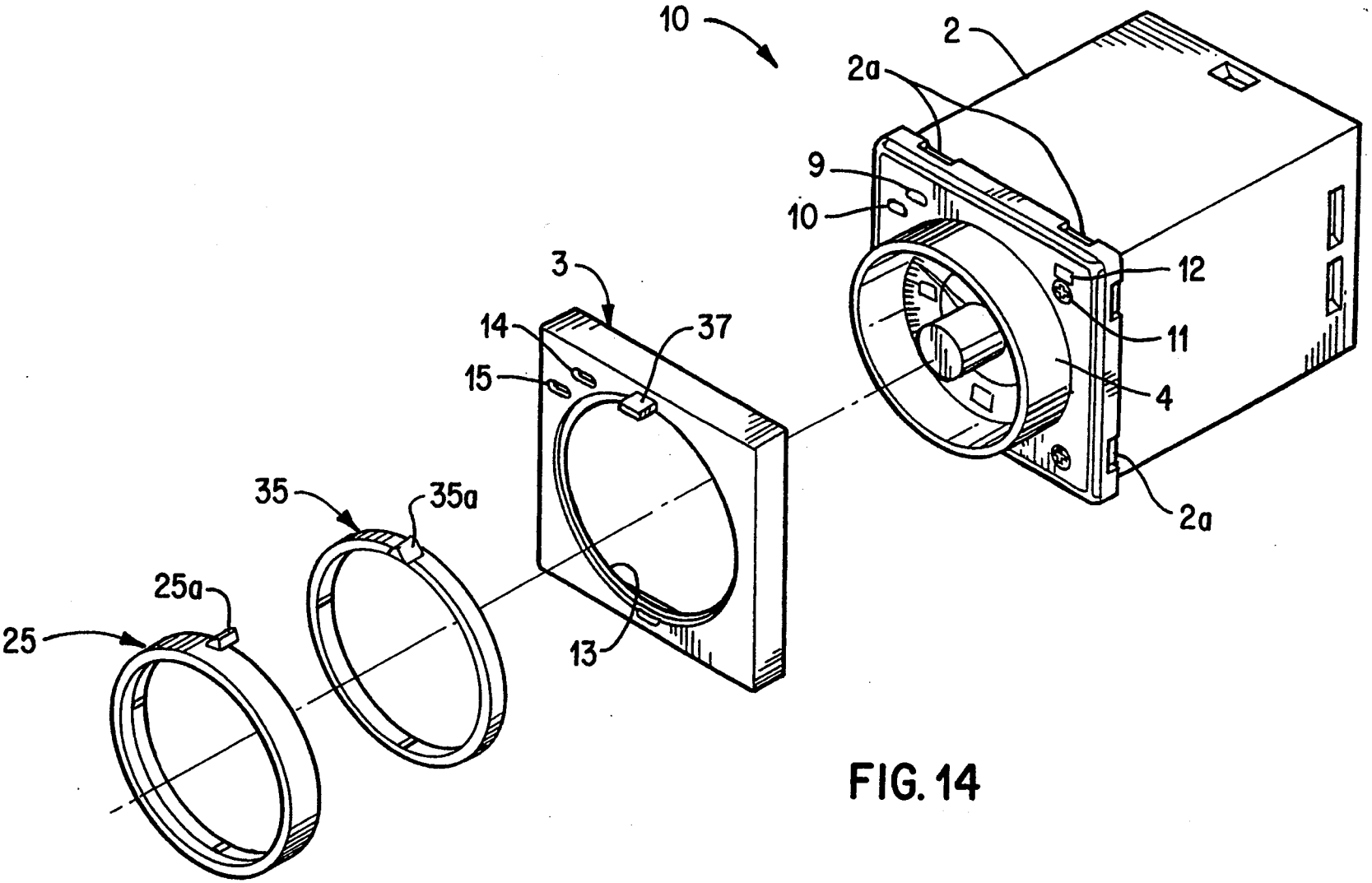
FIG. 14 is an exploded oblique view of third embodiment of the present invention.

FIG. 14 is an exploded oblique view of another dial-type timer in which a third embodiment of the present invention has been implemented. Components which correspond to those of the preceding embodiments have been given the same numbering.

The dial-type timer 10 of this embodiment consists of timer body 2; cover 3, which can be mounted on the face of the timer body 2; and setting rings 25 and 35, which are mounted on the perimeter of dial 4 on timer body 2 when the cover 3 is mounted on timer body 2. Unlike the previous embodiment, this timer does not have a stop 36 protruding from the upper portion of dial 4 on timer body 2.

As in the first embodiment, cover 3 is mounted on the face of timer body 20 when setting rings 25 and 35 are used. The cover has a round opening 13 for dial 4, and two small openings 14 and 15 for displays 9 and 10 on timer body 2.

Openings 13 through 15 are the only windows in cover 3. When this cover is mounted on the face of timer body 2, operating function switch 11 and the other setting switches are completely enclosed. With the cover in place, there is no possibility that anyone will operate these switches mistakenly.

Figure 15A:
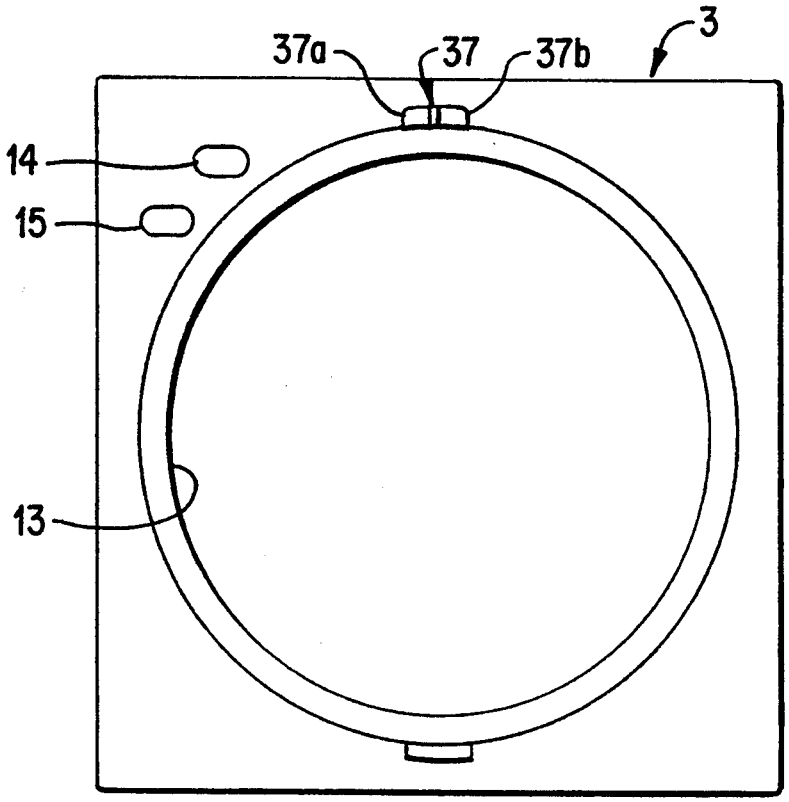
FIGS. 15A and 15B show a frontal view and a cross section of the side of the cover pictured in FIG. 14.

Stop 37 protrudes from the surface of cover 3 in a location corresponding to the upper face of the timer body 2, as shown in FIG. 15A, a frontal view, and 15B, a cross section of the side. Stop 37 limits the range of rotation of dial 4 when it is contacted by teeth 25*a* and 35*a* on setting rings 25 and 35. Surface 25*c* of tooth 25*a* on setting ring 25 comes in contact with surface 37*a* of stop 37. Surface 35*c* of tooth 35*a* on setting ring 35 comes in contact with surface 37*b* of stop 37.

Figure 15B:
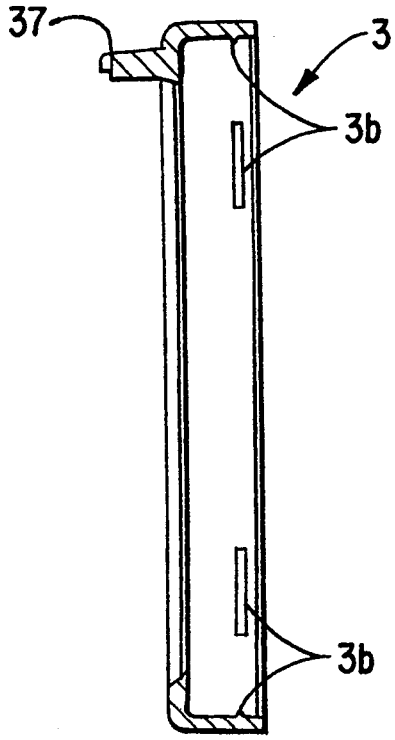

To mount cover 3 on the face of timer body 20, tabs 3*b* on the inner surface of cover 3 (shown in FIG. 15B) are inserted into slots 2*a* on timer body 2 (shown in FIG. 14).

Figure 16A:
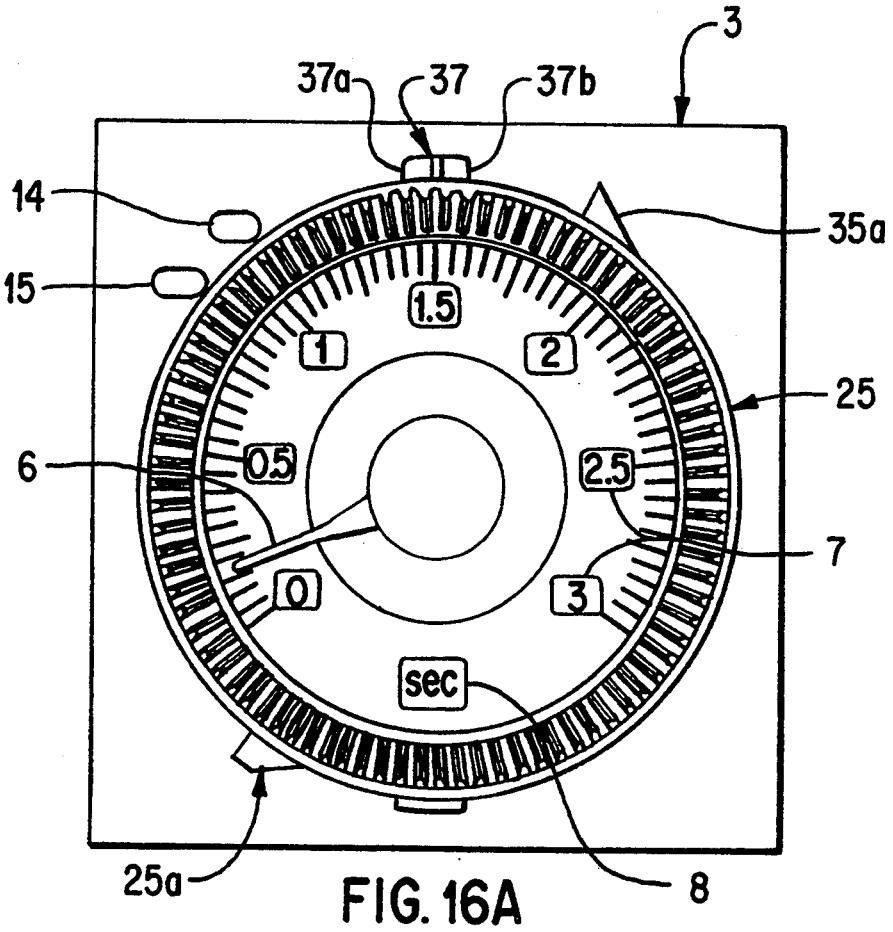
FIGS. 16A and 16B show a frontal view and a partial side view of the timer body with the two setting rings mounted on it.
Figure 16B:
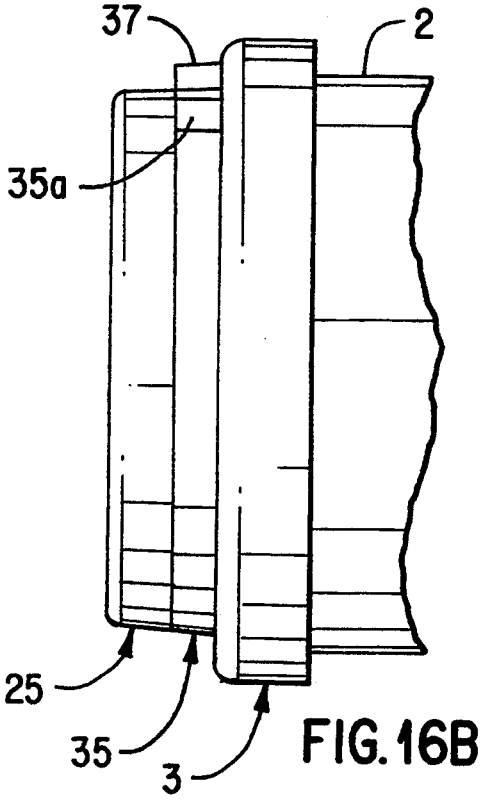

In dial-type timer 10, which is constructed as described above, the range of settings is controlled by the dial through the use of setting rings 25 and 35. First, cover 3 is mounted on the face of timer body 20. Dial 4 is set in the position corresponding to the lower limit of the allowable values, and surface 35*c* of tooth 35*a* on setting ring 35 comes in contact with surface 37*b* of stop 37 on cover 3. Setting ring 35 engages with the perimeter of dial 4. Dial 4 is then set in the position corresponding to the upper limit of the allowable values, causing surface 25*c* of tooth 25*a* on setting ring 25 to come in contact with surface 37*a* of stop 37 on timer body 20. Setting ring 25 then engages with the perimeter of dial 4. This process is illustrated in the frontal view shown in FIG. 16A and the partial side view in FIG. 16B. The setting on dial 4 can be changed only within the range between tooth 25*a* on setting ring 25 and tooth 35*a* on setting ring 35. The operator is prevented from setting any value outside of that range, just as in the previous example.

In this embodiment, the materials used for cover 3 and setting rings 25 and 35 are available in a variety of colors, so they can be chosen to match the color of the panel on which timer body 2 is mounted. This ensures an esthetically pleasing result.

Figure 17:
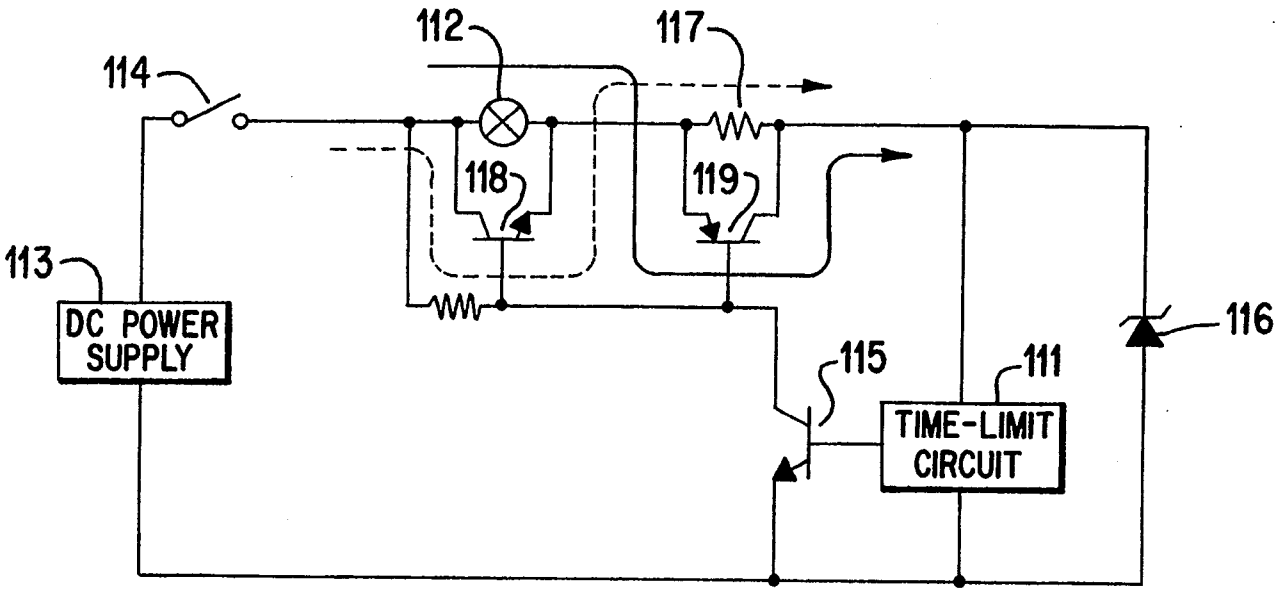
FIG. 17 shows the configuration of a circuit according to the present invention.

FIG. 17 shows the configuration of the circuit in a timing device in which this invention has been implemented. Elements 111 through 116 correspond to elements in a conventional circuit. Time-limit circuit 111, which comprises an integrated circuit (IC), and output relay 112 are connected in parallel to DC power supply 113 through switch 114. The base of an output switching element 115 is connected to the output terminal of the time-limit circuit 111. This element 115 is switched on and off by the output from time-limit circuit 111. The output relay 112 is connected in series with the collector-emitter pathway of output switching element 115. A diode 116 used to prevent reverse flow of current.

In FIG. 17, a dummy resistor 117, with virtually the same impedance as output relay 112, is connected in series with output relay 112 are connected to time-limit circuit 111. Switching elements 118 and 119 are connected in parallel respectively to the output relay 2 and dummy resistor 7. These switching elements are operated by the switching on or off of output switching element 5 in such a way that when one goes on, the other goes off.

In a timing device with the configuration described above, timing is begun when switch 114 is thrown. In the process of timing, current I, which supplied by DC power supply 113, flows into switching element 118 and dummy resistor 117, as shown by the dotted arrow. The specified power is supplied to time-limit circuit 111. When the specified time has elapsed, the aforesaid time-limit circuit determines that the time is up, and its output causes switching element 115 to go on. When element 115 switches on, switching element 118 goes off, and switching element 119 goes on. Current I from DC power supply 3 flows into output relay 112 and switching element 119, as shown by the solid arrow, and the specified power is supplied to time-limit circuit 111.

The impedance of the output relay 2 and of dummy resistor 7 are substantially identical, so the current does not vary either during timing or when timing has been completed. A virtually constant current is made to flow, and stable power can be supplied to time-limit circuit 111.

As has been discussed above, this invention entails connecting the output relay and the time-limit circuit in series so that the current which goes into the output relay flows unchanged into the time-limit circuit. This being the case, less current is required of the power supply, and a lower-capacity power supply can be used. Furthermore, there is virtually no fluctuation of current either during timing or when timing has been completed, so a constant current is made to flow regardless of whether the output relay is on or off. Current fluctuation is minimized throughout the circuit, stable power can be supplied to the time-limit circuit, and malfunctions can effectively be prevented.

Although preferred embodiments are specifically illustrated and described herein, it will be appreciated that modifications and variations of the present invention are covered by the above teachings and within the purview of the appended claims without departing from the spirit and intended scope of the invention.

What is claimed is:

1. A dial-type timer comprising:

a body containing a timing mechanism;

a dial for setting the operating time of said timing mechanism, said dial being provided on a face of said body;

a removably attached cover for covering said body face and having an opening through which said dial projects;

a first setting ring mounted on an outer periphery of said dial; and a first engaging portion provided on said cover and a second engaging portion provided on said outer periphery of said first setting ring, said first and second engaging portions engaging to determine a rotative position at which said first setting ring is to be set.

2. A timer as in claim 1, wherein said first engaging portion is formed as a projection on said cover, and said second engaging portion is formed as a projection on said first setting ring.

3. A dial-type timer comprising:

a body containing a timing mechanism;

a dial for setting the operating time of said timing mechanism, said dial being provided on a face of said body;

a first setting ring mounted on an outer periphery of said dial, said first setting ring having a first tooth provided on an outer periphery thereof;

a second setting ring mounted on an outer periphery of said dial, said second setting ring having a second tooth provided on the outer periphery thereof;

said first and second setting rings rotating in unison with said dial;

a stop member associated with said timer face which contacts with said first tooth and said second tooth to limit the range of rotation of said dial.

4. A timer as in claim 3, wherein said stop member is provided on said face.

5. A timer as in claim 3 wherein said stop member is provided on a cover which covers said face and which has an opening therein through which said dial passes.

6. The timer of claim 3 wherein said dial has grooves for mounting said first and second setting rings of ½ scale of units for time.

7. A dial-type apparatus for setting an operation range of a device, comprising:

a body containing an operation mechanism;

a dial for setting an operation range of said device;

a removably attached cover for covering a face of said body and having an opening through which an dial projects;

a first setting ring mounted on an outer periphery of said dial; and a first engaging portion provided on said cover and a second engaging portion provided on said outer periphery of said first setting ring, said first and second engaging portions engaging to determine a rotative portion at which said first setting ring is to be set.

8. A dial-type apparatus for setting an operation range of a device as in claim 7, wherein said first engaging portion is formed as a projection on said cover, and said second engaging portion is formed as a projection on said first setting ring.

9. A dial-type apparatus for setting an operation range of a device as in claim 7, wherein said dial has an indicator and a scale along an inside of circumference of said setting ring for setting said operation range.

10. A dial-type apparatus for setting an operation range of a device as in claim 7, wherein said dial has an indicator and a scale along an outside of circumference of said setting ring for setting said operation range.

11. A dial-type apparatus for setting an operation range of a device comprising:

a body containing an operation mechanism;

a dial for setting an operation range of said operation mechanism, said dial being provided on a face of said body;

a first setting ring mounted on an outer periphery of said dial, said first setting ring have a first tooth provided on an outer periphery thereof;

a second setting ring mounted on an outer periphery of said dial, said second setting ring having a second tooth provided on the outer periphery thereof;

said first and second setting rings rotating in unison with said dial; and a stop member associated with said timer face which contacts with said first tooth and said second tooth to limit the range of rotation of said dial.

12. A dial-type apparatus for setting an operation range of a device as in claim 11, wherein said stop member is provided on said face.

13. A dial-type apparatus for setting an operation range of a device as in claim 11, wherein said stop member is provided on a removably attached cover which covers said face and which has an opening therein through which said dial passes.

14. A dial-type apparatus for setting an operation range of a device as in claim 11, wherein said dial has grooves for mounting said first and second setting rings of ½ scale of units for time.

15. A dial-type apparatus for setting an operation range of a device as in claim 11, wherein said dial has an indicator and a scale along an inside of circumference of said first setting ring for setting said operation range.

16. A dial-type apparatus for setting an operation range of a device as in claim 11, wherein said dial has an indicator and a scale along an outside of circumference of said first setting ring for setting said operation range.

* * * * *